United States Patent [19]

Krömer

[11] 4,100,911

[45] Jul. 18, 1978

[54] ROTARY PISTON INTERNAL COMBUSTION ENGINE

[75] Inventor: Günter Krömer, Heilbronn, Fed. Rep. of Germany

[73] Assignee: Audi Nsu Auto Union Aktiengesellschaft, Fed. Rep. of Germany

[21] Appl. No.: 720,247

[22] Filed: Sep. 3, 1976

[30] Foreign Application Priority Data

Sep. 12, 1975 [DE] Fed. Rep. of Germany ..... 2540702

[51] Int. Cl.[2] ..... F03B 53/10

[52] U.S. Cl. ..... 123/205

[58] Field of Search ..... 123/8.09, 8.11, 8.13, 123/8.45, 32 ST

[56] References Cited

U.S. PATENT DOCUMENTS

| | | | |
|---|---|---|---|
| 3,196,846 | 7/1965 | Ohlendorf | 123/8.09 X |
| 3,196,852 | 7/1965 | Bentele | 123/8.09 |
| 3,246,636 | 4/1966 | Bentele | 123/8.09 |
| 3,286,697 | 11/1966 | Keylwert | 123/8.11 |
| 3,319,610 | 5/1967 | Hejj | 123/8.09 X |
| 3,699,929 | 10/1972 | Bennethum | 123/8.09 |
| 3,868,930 | 3/1975 | Klomp | 123/8.09 |
| 3,958,539 | 5/1976 | Satow | 123/8.09 |
| 3,976,035 | 8/1976 | Mitchell | 123/8.09 |

FOREIGN PATENT DOCUMENTS

| | | | |
|---|---|---|---|
| 1,027,787 | 4/1966 | United Kingdom | 123/8.09 |

*Primary Examiner*—Clarence R. Gordon
*Attorney, Agent, or Firm*—Kane, Dalsimer, Kane, Sullivan and Kurucz

[57] ABSTRACT

A rotary piston internal combustion engine of trochoidal construction with spark ignition and fuel injection, comprises a housing made up of a peripheral wall portion with a two-lobed inner surface having first and second nodes on its minor axis, and two parallel side portions. A three-cornered piston in the housing is rotatably mounted on the eccentric of an eccentric-carrying shaft, the piston having a recess in each flank and defining together with the inner peripheral surface of the housing working chambers of variable volume. Provisions are made in the housing near the first minor-axis node, an inlet port with a fuel metering device and an exhaust port for the escape of the burnt gases, and in which at least one sparking plug and an injection nozzle are arranged in the zone of the inner peripheral surface in which compression takes place.

5 Claims, 5 Drawing Figures

ROTARY PISTON INTERNAL COMBUSTION ENGINE

BACKGROUND OF THE INVENTION

In a known engine of the type described in German DT-OS No. 23 33 962, stratification of the charge in the working chamber is obtained by feeding a relatively lean fuel-air mixture through the inlet port and by blowing a fuel-vapor air mixture additionally into the working chamber. By means of such stratification of the charge the aim is to achieve both a reduction in the fuel consumption and also a substantial reduction in the pollutants in the exhaust gases. In this known construction it is arranged that the injection is directed into a recess in the rotating piston when the recess is opposite the sparking plug, which is placed well ahead of the second minor-axis node, the recess forming an increase in the cross-section of the volume in the neighborhood of the sparking plug for the purpose of slowing down the velocity of the flow. Stratification of the charge in a rotary piston engine with its combustion chamber having the shape of a sickle in cross-section, in which the relatively lean fuel mixture always has to be ignited by a rich mixture provided close to the sparking plug, cannot be relied upon to take place in all operating ranges under the given conditions, namely, a slowing down of the velocity of flow, as this can break down the rich mixture and can lead to variations in the fuel/air ratio which have an adverse effect on the stratification of the charge.

From German DT-OS No. 2 303 419 it is furthermore known to achieve stratification of the charge by providing an antechamber in the peripheral wall in the region of the second node, this chamber having a sparking plug and an injection nozzle and in which there is formed a rich fuel/air mixture, while the main working chamber contains a relatively lean fuel/air mixture formed by a carburetor or by a second injection nozzle. Such antechambers in the housing give rise to substantial thermal problems. Moreover, there are heat losses and transfer losses in the transfer of the ignited fuel/air mixture from the ante-chamber into the main working chamber through a relatively small opening, these losses reducing the power and increasing the fuel consumption under part-load conditions.

SUMMARY OF THE INVENTION

The invention is based on solving the problem of providing a rotary piston engine of the kind stated in the introduction above, in which stratification of the charge is achieved by simple means and which is of such a construction that regardless of the overall air ratio, an ignitable mixture with an air ratio of 0.9 to 1.1 λ is present at the sparking plug. (Where λ represents the stoichiometric ratio).

This aim is achieved according to the invention by the combination of the following features:

a. the sparking plug is arranged, looking in the direction of rotation of the piston, near the second minor-axis node in the region in which there are substantially equal pressures in the adjacent working chambers at the instant an apex seal of the piston passes it;

b. provided in each flank of the piston in the half of the flank which leads in the direction of rotation, is a recess from which a transfer passage extends into the region of the trailing half of the flank;

c. the injection nozzle is arranged ahead of the second minor-axis node, looking in the direction of rotation and injects fuel towards the piston in such a way that the spray of fuel is directed into the recess during rotation of the piston in a range between 40° and 100° eccentric angle ahead of top dead center; and d. a device is provided for controlling the fuel which regulates the quantity of fuel fed to the fuel metering device and/or the injection nozzle in such a way that there is always present in the recess at the instant of ignition a fuel/air ratio of λ 0.9 to 1.1, the overall quantity of fuel with the throttle closed being supplied mainly through the injection nozzle and in the remaining conditions of operation being supplied mainly through the fuel metering device.

The phrase "top dead center" is used for convenience, by analogy with a reciprocating engine, to define that position of the piston at which compression is a maximum.

By means of the proposal according to the invention there results in the top dead center position of the piston, a largely closed-off chamber formed by the recess in the piston and the adjacent wall of the housing, which lies opposite the sparking plug at the instant of ignition and which always contains an ignitable mixture independently of the fuel/air ratio in the overall working chamber, this mixture being capable of being ignited by the plug, so that the resulting flame which on further rotation of the piston passes from the trailing part of the working chamber at high velocity through the transfer passage to the leading part of the chamber, can ignite the incoming weak fuel/air mixture. In this way, it is possible to run with an overall air ratio of well over unity, for example of 2.0 λ, even in those ranges of operation in which otherwise the attainment of a reliably ignitable mixture at the sparking plug would require an overall air ratio of substantially below 1, that is to say, on starting and idling and on the overrun. Accordingly, under these conditions of operation, the fuel/air mixture drawn in through the inlet port can be relatively weak, which leads to a reduction in the deposition of the mixture on the wall of the inlet port and on the walls on the working chamber that is undergoing the induction phase. Moreover, with a closed throttle, no ignition failures and no interruptions of the combustion process can arise as an ignitable mixture is always present in the region of the sparking plug, so that, in particular on the overrun in a rotary piston engine used in a vehicle, irregular running can be avoided. With the engine warm on the other hand, there is no separation onto the walls of the chamber so it is possible to supply fuel through the fuel metering device without upsetting the fuel/air ratio.

The fuel metering device can comprise a carburetor forming a lean mixture and the control device can regulate solely the quantity of fuel fed to the injection nozzle. In this arrangement, the carburetor delivers a lean fuel/air mixture which according to the opening of the throttle, flows into the engine through the inlet port while through the ininjection nozzle there is injected a quantity of fuel which can be set by the control device to a value which results in a fuel/air ratio of 0.9 to 1.1 λ in the neighborhood of the sparking plug at the instant of ignition.

It is also possible for the fuel metering device in the inlet port to be in the form of an injection nozzle which has a lower injection pressure than the other nozzle, and for the two injection nozzles to be connected to the control device in common. In this construction the lean fuel/air mixture entering through the inlet port is produced by one injection nozzle and by means of the control device, according to the operating conditions, the overall quantity of fuel can be distributed between the two nozzles in such a way that the desired fuel/air ratio of 0.9 to 1.1 λ is always achieved in the region of the sparking plug.

Alternatively the injection nozzle in the inlet port can be connected to its own control device. In this case as well the control devices for the two nozzles can be adjusted in relation to each other in such a way that the fuel/air ratio at the sparking plug is 0.9 to 1.1 λ.

The control device used in the above-mentioned embodiments can be controlled in a known manner in accordance with load and speed in such a way that the value of the speed fed to the control device from the eccentric-carrying shaft has superimposed on it with progressive closing of the throttle, the value of the load given either by the throttle setting or by the depression present in the inlet port. In this way the overall quantity of fuel both at idling and also on the overrun can be supplied mainly through the injection nozzle whereas in the ranges of operation extending beyond this and up to full load conditions it can be fed mainly through the fuel metering device.

BRIEF DESCRIPTION OF THE DRAWINGS

Some embodiments of the invention by way of example are further described in the following with reference to the drawings in which.

DETAILED DESCRIPTION

Figure 1:
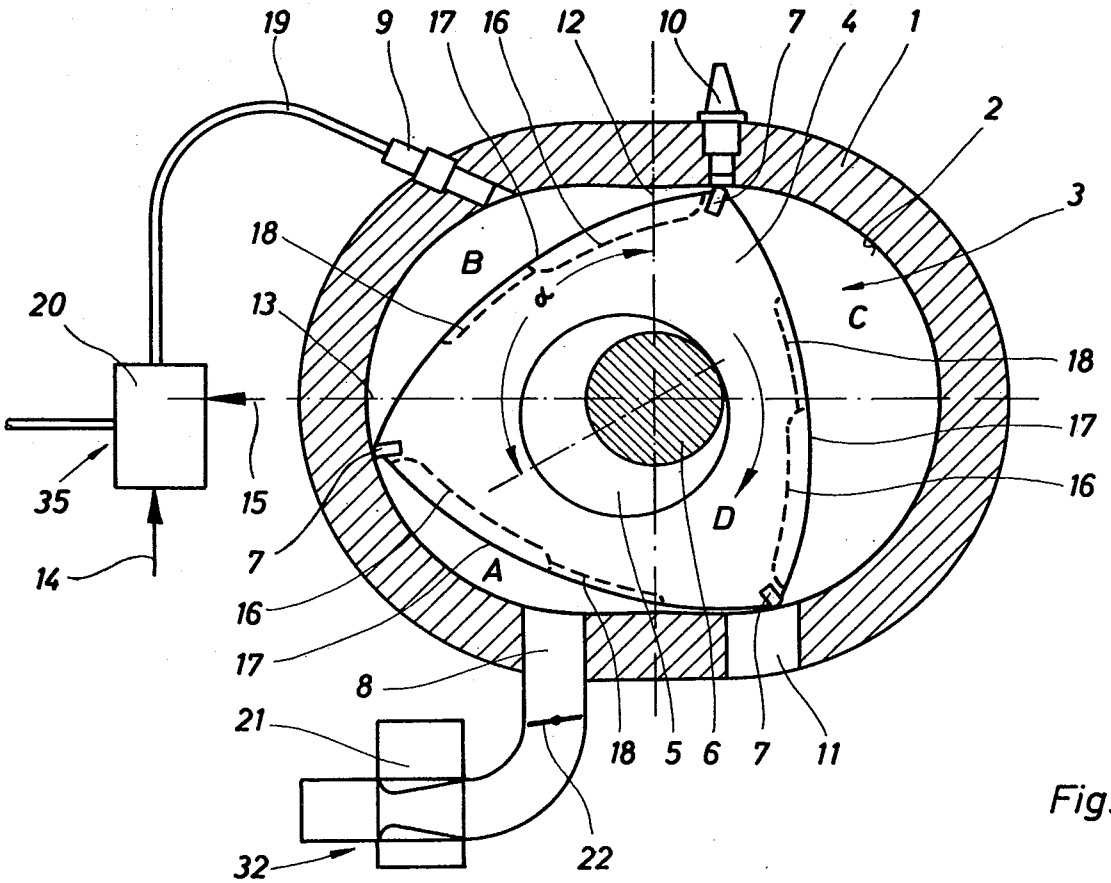
FIG. 1 shows diagrammatically and in section a rotary piston internal combustion engine of trochoidal construction with a first embodiment of a fuel supply device, the piston occupying a position about 120° of eccentric angle ahead of top dead center.

Reference is made first to FIG. 1 in which there is diagrammatically illustrated a rotary piston internal combustion engine of trochoidal construction having a housing made up of a peripheral wall portion 1 with a two-lobed inner peripheral surface 2 and parallel side walls portions 3 and in which there is a three-cornered piston 4 rotatably mounted on the eccentric 5 of an eccentric-carrying shaft 6. The piston 4 has at its corners apex seals 7 which are in continuous sliding contact with the inner peripheral surface 2 of the peripheral wall portion 1 as the piston 4 rotates in the direction D, to form working chambers A, B and C of variable volume. To carry out a four-phase cycle with charge stratification in each working chamber there are provided in the peripheral wall portion 1 an inlet port 8, an injection nozzle 9 and a sparking plug 10, as well as an exhaust port 11 for the burnt gases. The inlet port 8 has in this embodiment a fuel metering device in the form of a carburetor 21 with a throttle valve 22 and could be arranged instead in one or both side wall portions 3. As the piston 4 rotates each working chamber A, B and C performs successively an induction, compression, expansion and exhaust phase, and with the piston 4 in the position shown in the drawings, the chamber A is undergoing the induction phase, chamber B is in the compression phase and the chamber C is at the end of the expansion phase.

In the embodiment shown the sparking plug 10 is arranged at a position following the second minor axis node 12, looking in the direction of rotation D of the piston 4 in a region of the inner peripheral surface 2 in which as this region is passed by an apex seal 7 substantially the same pressures prevail in adjacent working chambers B and C separated by this seal 7, this being substantially the position of the piston 4 shown in the drawing and in which the shaft 6 is at an angle of about 120° ahead of top dead center. The injection nozzle 9 on the other hand, is arranged in a region of the inner peripheral surface 2 ahead of the second minor axis node 12 and following the major axis node 13, in which compression takes place. The nozzle is in an inclined position so that the spray of fuel for producing stratification of the charge is directed in the direction of rotation D towards the leading part of the flank 17 of the piston 4. In the leading part of each flank 17 of the piston 4 there is a recess 16 from which a transfer passage 18 extends into the trailing half of the flank 17.

The injection nozzle 9 is connected through a pipe 19 to a control device 35 in the form of a fuel injection pump 20 which adjusts the quantity of fuel, using known control members in accordance with the load and the speed of the engine, the values of which are fed in through inputs 14 and 15, the speed being taken from the shaft 6 and the load being indicated by the position of the throttle valve 22 or by the depression in the inlet port 8. Independently of the overall air ratio in the working chambers, the fuel/air ratio at the instant of ignition in the region of the recess 16 and the sparking plug 10 should always have a value between 0.9 and 1.1 λ and thereby achieve reliable ignition under all conditions of operation, and the value can be set according to requirements; a high exhaust gas temperature would mean a value of λ of 0.9 whereas fuel economy would dictate a value of λ of 1.1. In this embodiment the regulation for feeding the required quantity of fuel to the carburetor 21 and to the injection nozzle 9 for forming a stratified charge is achieved in such a way that the greater share of fuel is fed through the nozzle 9 when the throttle 22 is closed whereas in other conditions of operation the greater share is fed through the carburetor 21 connected to the inlet port 8.

Figure 2:
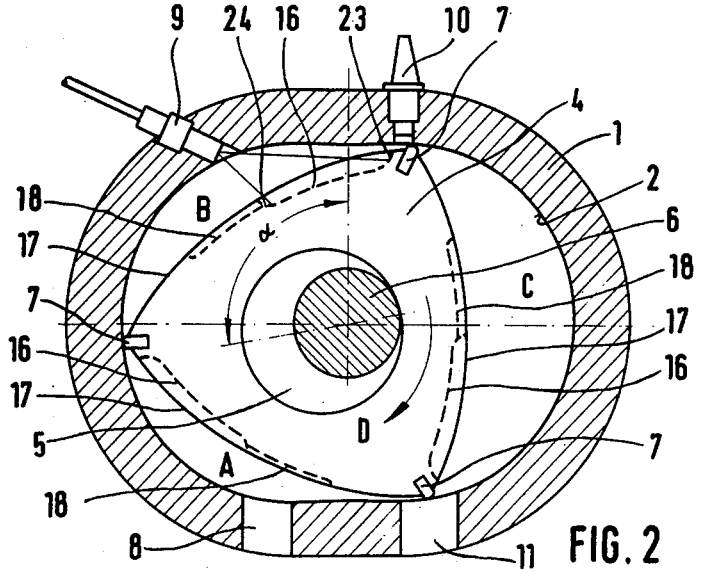
FIG. 2 shows the engine of FIG. 1 with the piston in a position about 100° before top dead center.

FIG. 2 shows the piston 4 in a position which is about 100° of eccentric angle α ahead of top dead center and in which the apex seal 7 has just passed the sparking plug 10. In this position during the compression phase in the working chamber B and as the piston 4 is rotating, fuel is injected from the nozzle 9 into the relatively weak mixture drawn in through the inlet port 8, the fuel being directed into the leading combustion chamber recess 16 in such a way that throughtout the period of the injection the stream of fuel as indicated in the drawing impinges on the recess 16 somewhere between its start 23 and its end 24, resulting in a local enrichment of the mixture. By virtue of the subsequent pinching of the flow in the direction of rotation D as a consequence of the rotary movement of the piston the injected fuel is on the one hand confined in the recess 16 and on the other hand intensively mixed with portions of the weaker mixture from the trailing half of the working chamber B before the onset of ignition.

Figure 3:
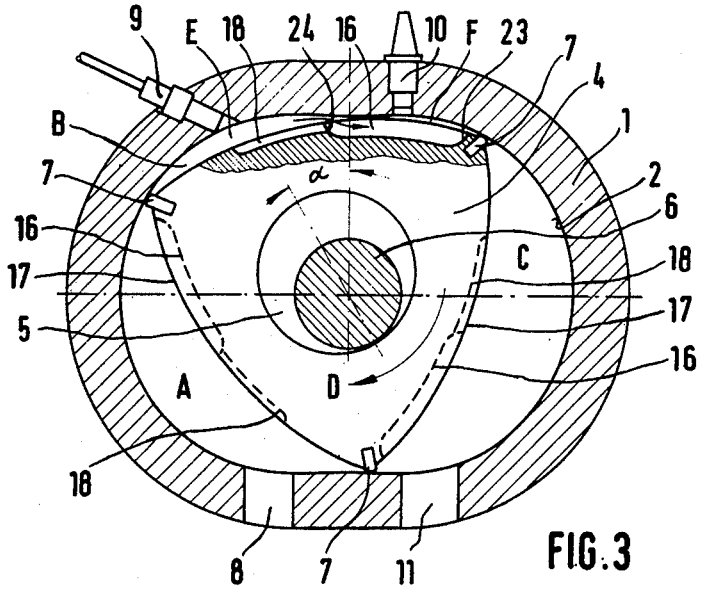
FIG. 3 shows the engine of FIG. 1 with the piston which is partially shown in section in a position about 30° of eccentric angle ahead of top dead center.

In FIG. 3 the piston 4 has turned in the direction D corresponding to an eccentric angle $\alpha$ of about 30° ahead of top dead center, so far that by virtue both of the shape of the piston flank 17 and the peripheral wall 2 and also the position of the recess 16 there are produced separate leading and trailing combustion chamber sections E and F, largely separated from one another, the leading section F and the recess 16 forming a common chamber. Into this chamber now the major part of the lean mixture from the other section E is forced via the connection between the leading and trailing halves of the flank formed by the transfer passage 18, as a result of the very strong tangential constricted flow in the direction of the arrow, resulting in very good and thorough turbulence and mixture formation. In this way, at the instant of ignition, which takes place at that instant where the piston 4 has turned substantially to the position illustrated and the recess 16 in the piston has its center of gravity below the sparking plug 10, there is present around the sparking plug 10 an ignitable fuel/air mixture of 0.9 to 1.1 $\lambda$. The fuel/air mixture still present in the section E of the combustion chamber is engaged and ignited by the flame after further rotation of the piston 4 as a consequence of the continued constricted flow.

Figure 4:
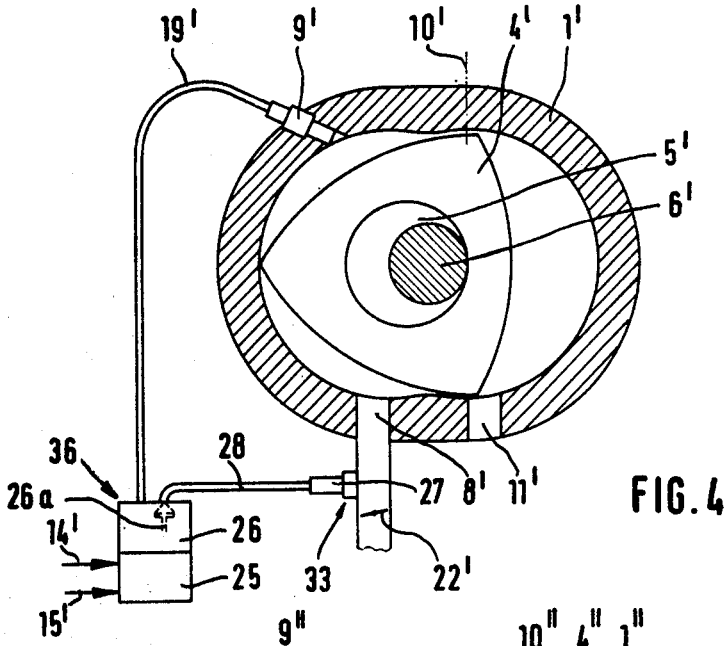
FIG. 4 shows a rotary piston engine similar to that of FIG. 1 to a smaller scale with a second embodiment of a fuel supply arrangement.

In the embodiment illustrated in simplified form in FIG. 4 the same reference numerals as in FIG. 1 have been used for the same and similar parts, but with the addition of an index mark. Differing from the embodiment of FIG. 1, an injection nozzle 27 is mounted in the inlet port 8' to form the fuel metering device 33 and together with the injection nozzle 9', it is connected to a common control device 36 which is in the form of a fuel injection pump 25 with a control portion 26. The regulation of the delivery of fuel to the two nozzles 9' and 27 is in accordance with the speed and load in such a way that the pipe 28 connected to the nozzle 27 that operates at the lower injection pressure is largely closed off by a valve 26*a* when the throttle 22' in the inlet passage 8' is also in the closed position, so that the major part of the fuel is supplied to the nozzle 9' while in the range of operation beyond this the supply to the nozzle 9' is reduced and the fuel is fed predominantly to the nozzle 27 that forms a lean mixture. Also in this case the quantities of fuel/air ratio of 0.9 to 1.1 $\lambda$ is present in the neighborhood of the sparking plug indicated at 10'.

Figure 5:
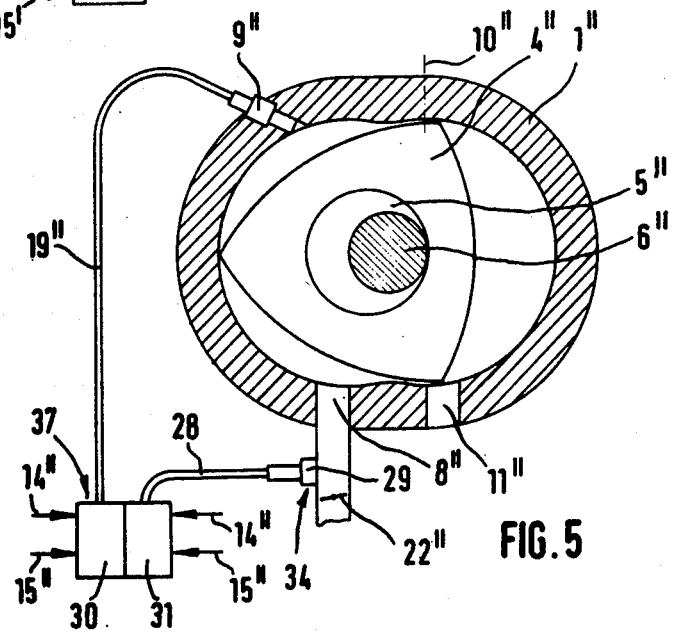
FIG. 5 shows an engine similar to that of FIG. 1 with a third embodiment of fuel supply arrangement.

In the embodiment illustrated in FIG. 5, in which the same reference numerals have been used as in FIGS. 1 and 4 for the same and similar parts, but with two index marks, it is arranged that, to control the quantity of fuel delivered to the nozzle 9'' and to the fuel metering device 34 in the form of an injection nozzle 29 there is a control device 37 with a separate respective controllable fuel injection pump 30 and 31 for each; just as in the earlier embodiments, the two pumps control independently the quantity of fuel delivered in accordance with the load and the speed of the engine, for example by adjustment of the stroke of the pump, but in such a manner that also in this embodiment in all ranges of load the fuel/air ratio in the neighborhood of the sparking plug 10'' is always 0.9 to 1.1 $\lambda$.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What I claim is:

1. A rotary piston internal combustion engine of trochoidal construction with spark ignition and fuel injection comprising:

a. a housing made up of a peripheral wall portion with a two-lobed inner peripheral surface having first and second nodes on its minor axis and two parallel side wall portions;

b. an eccentric carrying shaft and a three-cornered piston being mounted in the housing to rotate on the eccentric of the eccentric-carrying shaft;

c. a recess provided in the leading half of each flank of the piston, looking in the direction of rotation, said recesses defining together with the inner peripheral surface of the housing variable volume working chambers;

d. a transfer passage extending from the recess of each flank into the region of the trailing half of the flank;

e. an inlet passage, with a fuel metering device and a throttle valve, located in the housing near the first minor-axis node;

f. an exhaust port in the housing near the first minor-axis node for the excape of burnt gases;

g. at least one sparking plug mounted in the region of the peripheral surface where compression takes place, said sparking plug being placed at a point following the second node looking in the direction of rotation of the piston in the region in which, at the instant of passage of an apex seal of the piston, substantially equal pressure prevail in the two adjacent working chambers;

h. at least one injection nozzle mounted in the region of the inner peripheral surface where compression takes place, said injection nozzle being mounted ahead of the second node, looking in the direction of rotation, and arranged in an inclined manner to spray fuel towards the piston in such a way that the stream of fuel is directed into the recess during rotation of the piston in a region between 40° and 100° eccentric angle ahead of top dead center resulting in a local enrichment of the fuel/air mixture in the recess;

i. a fuel control device regulating the quantity of fuel fed to the fuel metering device and the injection nozzle so that there is always present in the recess at the instant of ignition a fuel/air mixture of 0.9 to 1.1 $\lambda$ substantially independently of fuel/air ratio in the working chambers, the overall quantity of fuel when the throttle is closed being supplied mainly to the injection nozzle, whereas in the remaining conditions of operation, it is supplied through the fuel metering device; and j. in the substantially top dead center position of the piston an overall compression chamber is formed and an essentially closed off chamber part is formed by the recess in the piston and the adjacent surfaces of the housing, said closed off chamber part containing an ignitable mixture substantially independently of the fuel/air ratio in the overall compression chamber and being substantially opposite the sparking plug at the instant of ignition, the ignitable mixture being capable of being ignited by the plug, so that the resulting flame which on further rotation of the piston passes from the trailing part of the recess at relatively high velocity through the transfer passage to ignite the incoming fuel/air mixture in the remainder of the compression chamber.

2. An engine according to claim 1 in which the fuel metering device comprises a carburetor forming a lean fuel/air mixture and the control device regulates solely the quantity of fuel fed to the injection nozzle.

3. An engine according to claim 1 in which the fuel metering device is in the form of an injection nozzle which has a lower injection pressure than the other nozzle and both injection nozzles are connected in common to the control device.

4. An engine according to claim 1 in which the fuel metering device is in the form of an injection nozzle and each injection nozzle has connected to it its own control device.

5. An engine according to claim 1 in which the control device is controlled in accordance with load and speed in such a way that the value of the speed fed to the control device has progressively superimposed on it, with increasing closure of the throttle, the value of the load given either by the setting of the throttle or by the depression in the inlet port.

* * * * *